US005540384A

United States Patent [19]

Erickson et al.

[11] Patent Number: 5,540,384

[45] Date of Patent: Jul. 30, 1996

[54] ULTRASONIC SPRAY COATING SYSTEM

[75] Inventors: John J. Erickson, Newburyport, Mass.; Joseph R. Marshall, Port Ewen, N.Y.

[73] Assignee: Ultrasonic Systems, Inc., Amesbury, Mass.

[21] Appl. No.: 116,015

[22] Filed: Sep. 2, 1993

Related U.S. Application Data

[63] Continuation-in-part of Ser. No. 791,412, Nov. 13, 1991, abandoned, which is a continuation-in-part of Ser. No. 469,937, Jan. 25, 1990, abandoned.

[51] Int. Cl.[6] ..... B05B 17/06

[52] U.S. Cl. ..... 239/102.2

[58] Field of Search ..... 239/102.1, 102.2, 239/4; 427/424

[56] References Cited

U.S. PATENT DOCUMENTS

| | | | |
|---|---|---|---|
| 3,198,170 | 8/1965 | Onishi | 239/102.2 |
| 4,085,893 | 4/1978 | Durley | 239/102.2 |
| 4,153,021 | 5/1979 | Berger et al. | 239/102.2 |
| 4,520,786 | 6/1985 | Thatcher et al. | 123/526 |
| 5,387,444 | 2/1995 | Bachmann | 239/102.2 X |
| 5,409,163 | 4/1995 | Erickson et al. | 239/4 |

*Primary Examiner*—Kevin P. Weldon
*Attorney, Agent, or Firm*—Heslin & Rothenberg, P.C.

[57] ABSTRACT

An ultrasonic spray coating system includes a converter which converts high frequency electrical energy into high frequency mechanical energy thereby producing vibrations. The converter has a resonant frequency. A spray head is coupled to the converter and is resonant at the resonant frequency of the converter. The spray head has an atomizing surface and a feed blade to the atomizing surface and concentrates the vibrations of the converter at the atomizing surface. A source of high frequency alternating voltage is electrically connected to the converter and produces a controlled level of electrical energy at the resonant frequency of the spray head and converter whereby the atomizing surface is vibrated ultrasonically. A fluid supply applicator is in close proximity with the feed blade to the atomizing surface and spaced therefrom. The fluid supply applicator has an output surface having orifice means therein and the output surface is in close proximity with the feed blade to the atomizing surface and spaced therefrom. The output surface of the fluid supply applicator and the atomizing surface are at right angles to each other, whereby fluid supplied by the applicator to the feed blade flows by surface wave action to the atomizing surface where the fluid is atomized by the ultrasonic vibrations of the atomizing surface and thereby changed to a spray.

12 Claims, 3 Drawing Sheets

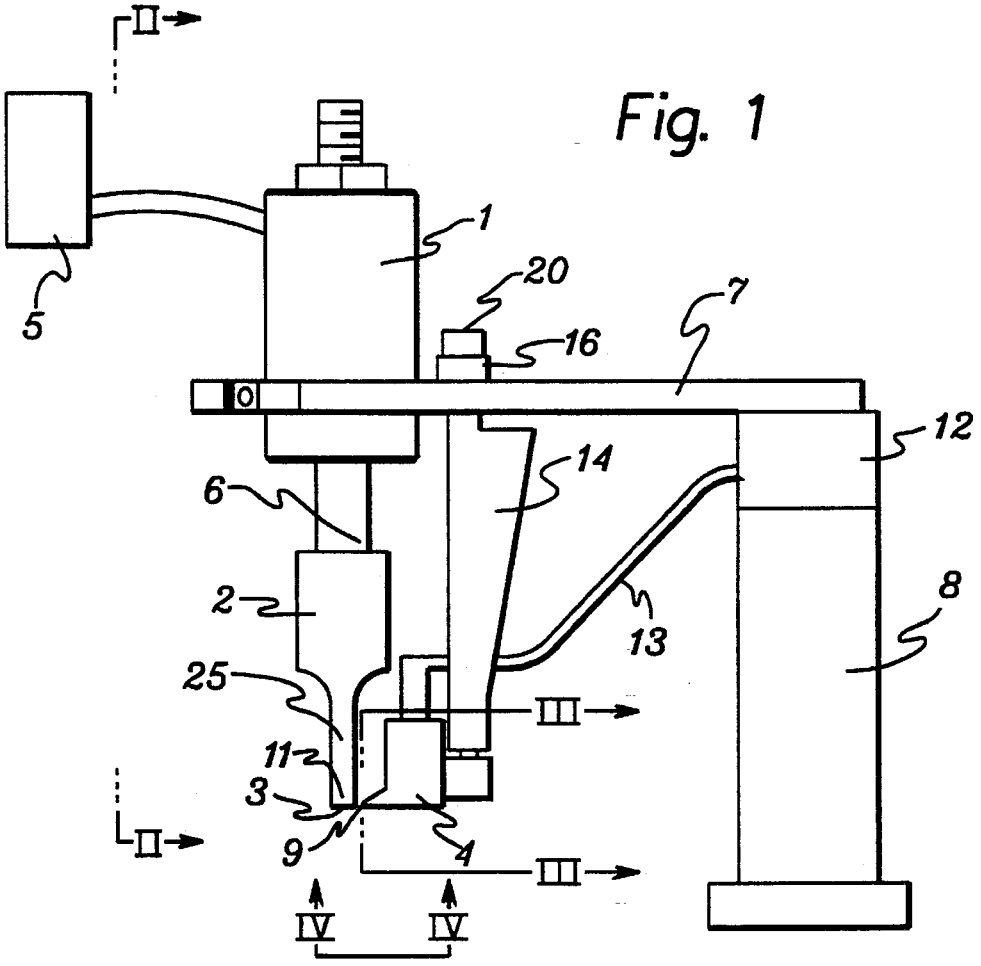
Fig. 1
Fig. 2
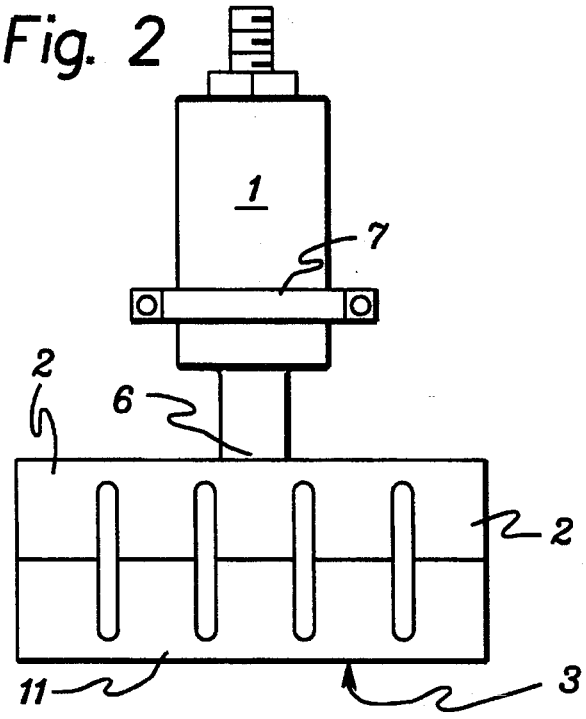
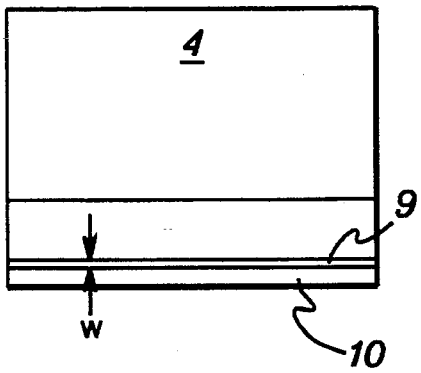
Fig. 3

ULTRASONIC SPRAY COATING SYSTEM

BACKGROUND OF THE INVENTION

This application is a continuation-in-part of application Ser. No. 07/791,412 for Ultrasonic Spray Coating System, filed Nov. 13, 1991, now abandoned, which, in turn, is a continuation-in-part of application Ser. No. 07/469,937 for Ultrasonic Spray Coating System, filed Jan. 25, 1990 and now abandoned.

The present invention relates to an ultrasonic spray coating system. More particularly, the invention relates to an ultrasonic spray coating system having a fluid applicator in close proximity with the feed blade to the atomizing surface. This invention relates to an atomizing spray coating system appropriate for applying a wide variety of coating materials to products in industry. More particularly, the invention relates to a spray coating system which includes liquid supply means, air entrainment means and high energy ultrasonic structures in conjunction with high energy ultrasonic power generators to produce the desired results.

This invention is an improvement over pending application Ser. No. 07/396,285 now abandoned of John J. Erickson. More particularly, the invention relates to an ultrasonic spray coating system with a liquid supply control system in close proximity with, but not contacting, the feed blade to the atomizing surface and the design and control of the vibrating surface.

Presently available techniques for atomizing and applying coating materials to surfaces of products include discharging liquids through small apertures under high applied pressure, introducing the liquid to the center of a high speed rotating disk, introducing the liquid into a high velocity stream of air, introducing a liquid jet or film to an intense electrical field and introducing the liquid to a surface which is caused to vibrate at an ultrasonic frequency. The advantages and disadvantages of the various known implementations of the atomizing techniques are extensively documented in technical journals and texts. Thus, for example, a comprehensive technical survey of the known methods is described in "Atomization and Sprays", by Arthur J. Lefebvre, Purdue University, Hemisphere Publishing Corporation, 1989.

Ultrasonic liquid atomizing spray systems have generated considerable attention as evidenced by prior art U.S. patents. It is known in the prior art that a film of liquid on a surface can be converted into a mist of small drops by vibrating the surface at an ultrasonic rate. Also, prior art teaches that the size of the drops in the mist are inversely proportional to the rate of vibration. However, problems associated with introducing liquid to a vibrating surface in a manner to produce dependable, uniform spray patterns have significantly limited the effectiveness and therefore the commercial acceptance of prior art approaches. Also, problems with controlling the precise amplitude of the vibrations in the various sections of the surface significantly influences the characteristics of the produced spray and affects the quality of an applied coating.

In known ultrasonic spray coating systems, the coating material is first disintegrated into a fog of tiny droplets which is injected into a laminar gas stream to create a laminar material spray. The spray is directed at an item to be coated. The flow rate of material being disintegrated is regulated to control the volume of material injected into the gas stream, thereby controlling the volume of material applied to the item and, hence, the concentration of solids which remain after coating.

The known method of coating is very expensive and difficult to undertake. Furthermore, it is inefficient, because it coats everything in the area of the item, as well as the item. The prior art design approaches have failed to provide adequate means to achieve spray patterns which produce coatings of desired uniformity and definition. There is a great commercial need for improved techniques and systems for applying liquid coating material to surfaces such as printed circuit boards, semiconductor wafers, continuous sheets of float glass, automobile trim, continuous sheets of woven and non-woven materials, etc., with desired precision, efficiency and rapidity.

Ultrasonic liquid atomizing spray systems have generated considerable attention. It is shown in the prior art that a film of liquid on a surface can be converted into small drops by vibrating the surface at an ultrasonic rate. Prior art teaches that the size of the drops are a function of the vibration frequency and amplitude. Also, prior art shows many ways of introducing the liquid to a vibrating surface. However, problems associated with introducing a sufficient flow of liquid to an ultrasonically vibrating surface in a manner to produce dependable, uniform spray patterns have significantly limited the effectiveness and therefore the commercial acceptance of prior art approaches. Additionally, problems with controlling the flow of ultrasonic energy into the atomizing liquid significantly influences the characteristics of the produced spray and the resultant quality of an applied coating.

Prior art approaches generally describe various cylindrical nozzle shaped ultrasonic structures with the liquid spray material introduced in the center of the nozzle atomizing surface and also occupying a portion of the path of the ultrasonic energy propagation. The basic difficulties with these approaches are that considerable ultrasonic energy is lost to the liquid supply connections and the liquid within the structure and the spray patterns produced by such structures are cylindrical thereby coating thickness distributions on surface lend toward gaussian rather than uniform.

The principal object of the invention is to provide an ultrasonic spray coating system which is inexpensive in manufacture and operation.

An object of the invention is to provide an ultrasonic spray coating system of simple structure which is maintained and utilized with facility, ease and economy.

Another object of the invention is to provide an ultrasonic spray coating system which is efficient in operation and facilitates the coating of desired surfaces only.

Still another object of the invention is to provide an ultrasonic energized spray coating system which produces a coating of liquid of desired uniformity, precision and thickness on desired surfaces.

Yet another object of the invention is to provide an ultrasonic liquid spray coating system which is repeatably manufacturable, easily maintained and operated.

Another object of the invention is to provide an ultrasonic energized spray coating system which can form sprays from a wide range of coating liquids with equal uniformity and precision.

Still another object of the invention is to provide an ultrasonic energized spray system which is economical to manufacture and operate and which sprays coatings with minimal waste of coating liquid.

Yet another object of the invention is to provide an ultrasonic spray coating system which utilizes a half wave, stepped rectangular horn, ultrasonic structure to concentrate and direct the ultrasonic energy uniformly to the feed blade to the atomizing surface.

Another object of the invention is to provide an ultrasonic spray coating system which utilizes a liquid applicator member with an internal formed rectangular passage which introduces liquid to the atomizing surface by the surface wave on the feed blade.

Still another object of the invention is to provide an ultrasonic spray coating system which shapes a rectangular passage in the liquid applicator in the form of a slotted orifice with a length equal to the spray head width and a width proportioned according to the required liquid flow rate.

Yet another object of the invention is to provide an ultrasonic spray coating system which produces precise, bubble-free coatings on either fiat or irregular surfaces.

Another object of the invention is to provide an ultrasonic spray coating system which delivers over 90% of the atomized liquid to the surface to be coated.

Still another object of the invention is to provide an ultrasonic spray coating system which is easily maintained and has equipment with a long life.

Yet another object of the invention is to provide an ultrasonic spray coating system which causes minimal environmental pollution of spray materials.

BRIEF SUMMARY OF THE INVENTION

In a typical form of the present invention, the ultrasonic spray coating system comprises a converter for converting high frequency electrical energy from an electronic frequency controlled power generator into high frequency mechanical energy and thereby producing sonic energy and vibrations. The converter has a resonant frequency. A spray head is coupled to the converter and is resonant at the resonant frequency of the converter. The spray head concentrates the sonic energy generated by the converter at the atomizing surface causing the atomizing surface to vibrate uniformly over the plane of the surface and normal to the direction of sonic wave propagation with an amplitude proportional to the electric energy applied to the converter. A liquid supply has a liquid applicator mounted in close proximity with the feed blade to the atomizing surface and spaced therefrom a small distance determined by the surface tension and other liquid properties which allows the liquid to form a meniscus in the gap between the applicator and the spray head. A meniscus is intended to mean a crescent-shaped body. The liquid is then caused to flow to and on the entire area of the atomizing surface by the movement of sonic surface waves produced by the compressional wave in the blade of the resonant horn. The liquid is then broken into small drops at the surface of capillary waves and the walls of cavitation bubbles which form in the liquid due to the action of high energy sonic waves and which are carried away from the surface by the action of the sonic waves which propagate from the surface of the spray head. A low velocity laminar air stream is produced by introducing compressed air to an air director mounted at the step of the spray head and a slotted gap formed between the step radius and the air director. The low velocity laminar air stream then is caused to entrain the spray drops and aids in the precision deposition of the drops on a surface to be coated.

The voltage generator drives multiple spray assemblies of the same operating frequency in electrical parallel. The circuitry is designed to include the spray head assemblies in the frequency control path for automatic frequency control and to adjust power according to system demand. The power generator features a unique full bridge power output circuit configuration together with a frequency driven pulse mode driver. The converter comprises a half wave cylindrical composite structure utilizing ring shaped piezoelectric ceramics and metal sections in a typical Langevin type sandwich structure. A cylindrical flange is formed at the ceramic end of one of the metal sections about which is fitted one end of a protective cover for the ceramic section. The flange is located at the nodal plane of the resonant structure thereby eliminating loss of ultrasonic energy to the cover element. A coaxial type electrical conductor is brought through a port in the other end of the cover. The cover ends are sealed liquid and gas tight. The exposed end of the structure is drilled and threaded to enable mechanical connection to a solid spray head section. The converter structure is designed to be operated at a specific desired frequency. All exposed surfaces are made from materials selected for minimum corrosion when exposed to spray materials.

A spray head, or plurality of spray heads, are half wave resonant at the same frequency of matching converter drivers. Spray heads are designed considering first the type and rate of flow of liquid to be sprayed in order to determine the frequency and energy requirements and the second width of the spray pattern to determine the area and length of the atomizing tip of the spray head. Thereby spray heads may be custom matched to the application and driven by standard converters and can be easily replaced if erosion occurs due to use. The liquid applicator is provided with a slotted passage with a slot length equal to slightly less than the width of the spray head and a height determined sufficient to permit the desired amount of liquid to be applied to the atomizing surface. The shape and dimensions of the liquid passage in the applicator are critical to the uniform control of the flow of liquid to the entire area of the atomizing surface. The air entrainment is provided with a shaped narrow passage which together with the step radius directs low pressure compressed air to flow toward the spray head feed blade to the atomizing surface. The size, shape and position of the air applicator is critical to the formation of the air entrainment pattern.

In accordance with the invention, an ultrasonic spray coating system comprises converter means for converting high frequency electrical energy into high frequency mechanical energy thereby producing vibrations. The converter means has a resonant frequency. Spray head means coupled to the converter means and resonant at the resonant frequency of the converter means, has an atomizing surface and a feed blade to the atomizing surface and concentrates the vibrations of the converter at the atomizing surface. High frequency alternating voltage means electrically connected to the converter means produces a controlled level of electrical energy at the resonant frequency of the spray head and converter means whereby the atomizing surface is vibrated ultrasonically. Fluid supply means has a fluid supply applicator in close proximity with the feed blade to the atomizing surface and spaced therefrom. The fluid supply applicator has an output surface having orifice means therein and the output surface is in close proximity with the feed blade to the atomizing surface and spaced therefrom. The output surface of the fluid supply applicator and the atomizing surface are at substantially right angles to each other whereby fluid supplied by the applicator to the feed blade flows by surface wave action to the atomizing surface where the fluid is atomized by the ultrasonic vibrations of the atomizing surface and is thereby changed to a spray.

The spray head means has a substantially rectangular spray head and the atomizing surface and the output surface of the applicator have substantially parallel lengths. The orifice means is a continuous slot extending substantially parallel to and for the length of the output surface.

The slot has a width in the range of substantially 2 to 12 μm.

In accordance with the invention, an ultrasonic spray coating system comprises converter means for converting high frequency electrical energy into high frequency mechanical energy thereby producing vibrations. The converter means has a resonant frequency. Spray head means coupled to the converter means and resonant at the resonant frequency of the converter means has an atomizing surface and a fed blade to the atomizing surface and concentrates the vibrations of the converter at the atomizing surface. High frequency alternating voltage means electrically connected to the converter means produces a controlled level of electrical energy at the resonant frequency of the spray head means and converter means whereby the atomizing surface is vibrated ultrasonically. Fluid supply means has a fluid supply applicator in close proximity with the feed blade to the atomizing surface and is spaced therefrom in a manner whereby fluid supplied by the applicator to the feed blade flows to the atomizing surface where the fluid is atomized by the ultrasonic vibrations of the atomizing surface and is thereby changed to a spray. Mounting bracket means affixes the converter means, the spray head means and the fluid supply applicator of the fluid supply means to the mounting means.

An applicator bracket is adjustably affixed to the mounting bracket means and the fluid supply applicator is affixed to the applicator bracket whereby the applicator is adjustably positioned relative to the feed blade to the atomizing surface of the spray head means.

In accordance with the invention, an ultrasonic spray coating system comprises converter means for converting high frequency electrical energy into high frequency mechanical energy thereby producing vibrations. The converter means has a resonant frequency. Spray head means coupled to the converter emans and resonant at the resonant frequency of the converter means has an atomizing surface and a feed blade to the atomizing surface and concentrates the vibrations of the converter means at the atomizing surface. High frequency alternating voltage means electrically connected to the converter means produces a controlled level of electrical energy at the resonant frequency of the spray head and converter means whereby the atomizing surface is vibrated ultrasonically. Fluid supply means has a fluid supply applicator in close proximity with the feed blade to the atomizing surface and spaced therefrom in a manner whereby supplied by the applicator to the feed blade flows by surface wave action to the atomizing surface where the fluid is atomized by the ultrasonic vibrations of the atomizing surface and is thereby changed to a spray. Mounting bracket means affixes the converter means, the spray head means and the fluid supply applicator of the fluid supply means to mounting means. An applicator bracket adjustably affixed to the mounting bracket means and the fluid supply applicator is affixed to the applicator bracket whereby the applicator is adjustably positionable relative to the feed blade to the atomizing surface of the spray head means in planes substantially parallel to and in planes substantially perpendicular to the atomizing surface. The fluid supply applicator has an output surface having orifice means therein and the output surface is in close proximity with the feed blade to the atomizing surface and spaced therefrom. The output surface of the applicator and the atomizing surface are at substantially fight angles to each other.

BRIEF DESCRIPTION OF THE DRAWINGS

In order that the invention may be readily carried into effect, it will now be described with reference to the accompanying drawings, wherein:

FIG. 1 is a block diagram of an embodiment of the ultrasonic spray coating system of the invention;

FIG. 2 is a view, taken along the lines II—II, of FIG. 1;

FIG. 3 is a view, on an enlarged scale, taken along the lines III—III, of FIG. 1;

DETAILED DESCRIPTION OF A PREFERRED EMBODIMENT

Figure 4:
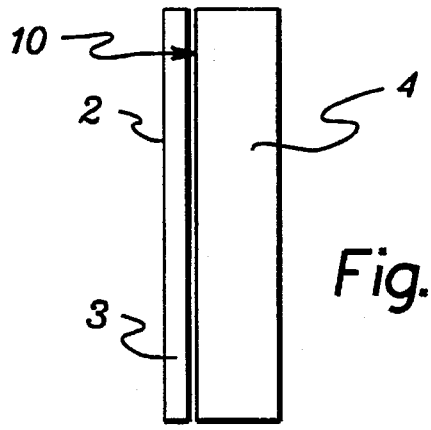
FIG. 4 is a view, on an enlarged scale, taken along the lines IV—IV, of FIG. 1.

The components of the ultrasonic spray system of the invention, shown in FIG. 1, are a converter or transducer 1 which produces vibrations by converting high frequency electrical energy into high frequency mechanical energy. A spray head 2, which is preferably rectangular, is disclosed and described in copending patent application Ser. No. 396,285 of the present inventor, filed Aug. 21, 1989 for Ultrasonic Liquid Atomizer. The spray head 2 is resonant at the converter resonant frequency and concentrates the vibrations at its atomizing, or feed blade surface 25. The spray head 2, including the feed blade, etc., preferably comprises titanium and, most preferably Ti-6Al-4V, (Timer Corp., 400 Rouser Road, Pittsburgh, Pa. 15230). A fluid supply applicator 4 distributes fluid to the spray head vibrating surface 3. A high frequency alternating voltage generator 5 produces a controlled level of electrical energy at the resonant frequency of the spray head converter system.

As disclosed in copending patent application Ser. No. 396,285, now abandoned the converter 1 is a resonant structure which delivers a maximum vibration amplitude to its end 6. The converter 1 may, as described in copending patent application Ser. No. 396,285, now abandoned comprise a derivative of the Langevin sandwich type which uses lead zirconate titanate, or PZT, for the piezoelectric material and aluminum, stainless steel, or titanium, for the metal. The PZT elements (not shown in the FIGS.) are preferably sandwiched between the metal elements by a high central bolt, as described in copending patent application Ser. No. 396,285, now abandoned tightened to provide a bias compressive pressure sufficient to prevent fatigue failure of the crystal material.

The PZT elements are protected from contamination and damage by a high quality electronic coating and cover attached at a nodal plane to avoid energy losses. The converter 1 is physically tuned to operate within ±0.05% of the design frequency. Electrical energy is applied to the PZT elements from the alternating voltage generator 5 adjusted to operate at the resonant frequency of the structure.

A mounting bracket 7 affixes the converter 1, the spray head 2 and the fluid supply applicator 4 to a mounting frame, or platform 8, as shown in FIG. 1.

The spray head 2 is preferably rectangular, as described in copending patent application Ser. No. 396,285, now abandoned and is designed and physically tuned to be resonant at the frequency of the driving converter 1. This type of resonant structure is described in "Ultrasonic Engineering" by J. R. Frederick, John Wiley and Sons, Inc., 1965. The converter 1 is affixed to the spray head 2 by a tension bolt (not shown in the FIGS.) which permits assembly and disassembly, as required for maintenance, or other operations. The sonic path from the converter 1 through the feed blade 25 to the atomizing surface 3 is designed to provide a maximum displacement with minimum electrical energy to said converter.

Fluid is introduced to the feed blade 25 to the atomizing surface 3 of the spray head 2 from a slitted or slotted orifice 9 (FIGS. 1 and 3) formed in the output surface 10 of the fluid supply applicator 4, having a slot length equal to the length of said spray head and mounted in close proximity with said feed blade 25 to the atomizing surface and spaced from the tip 11 (FIG. 1) of said spray head in a manner whereby fluid supplied by said applicator to said feed blade 25 flows by surface wave action to said atomizing surface where said fluid is atomized by the ultrasonic vibrations of said atomizing surface and is thereby changed to a spray. The fluid flow rate and vibration amplitude must be controlled m maintain desired fluid atomization.

The output surface 10 of the applicator 4 is in close proximity with the feed blade to the atomizing surface 3 and spaced therefrom and said output surface and atomizing surface are at substantially right angles to each other, as shown in FIGS. 1 and 4. The atomizing surface 3 and the output surface 10 have substantially parallel lengths, as shown in FIG. 4, and the orifice 9 (FIGS. 1 and 3) is a continuous slot with a width W, as shown in FIG. 3, in the range of substantially 2 to 12 μm. The width W is sufficient to permit the desired flow of fluid or liquid to be applied to the feed blade 25 to the atomizing surface 3. The shape and dimensions of the liquid passage in the applicator is critical to the uniform control of fluid or liquid to the atomizing surface 3.

The fluid supply applicator 4 may be customized during final assembly for each application. The applicator 4 provides a reservoir for the fluid, which is distributed to the spray head 2 via the orifice 9. The applicator 4 is coupled to an external fluid supply or reservoir 12 via swage type tube fittings 13 (FIG. 1). The fluid supply 12 and the orifice 9 are designed in accordance with hydrostatic principles to provide a steady fluid flow to the feed blade 25 to the atomizing surface 3 of the spray head 2. The width W of the orifice 9 is proportioned in accordance with the type of fluid being applied.

Figure 5:
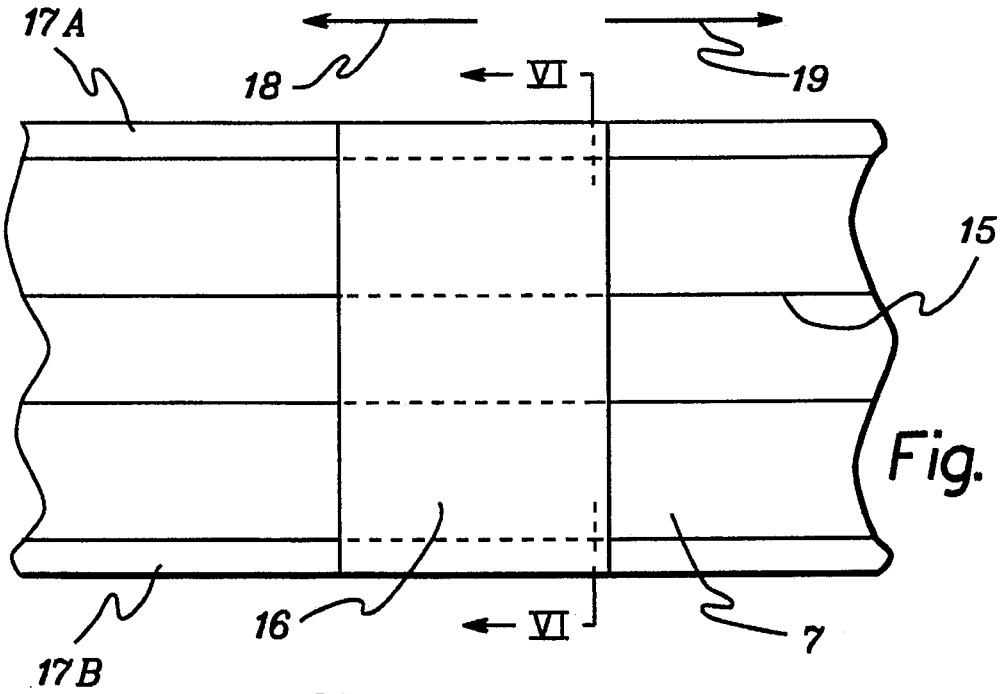
FIG. 5 a top plan of FIG. 1.

The fluid supply applicator 4 is affixed to an applicator bracket 14, which is affixed to the mounting bracket 7 (FIG. 1). The mounting bracket 7 has a linearly extending slot 15 formed therethrough, as shown in FIG. 5. The applicator bracket 14 is supported by a carriage 16 of any suitable type via a portion of said applicator bracket extending through the slot 15 whereby said applicator bracket is suspended from said carriage on the mounting bracket. The carriage 16 is movable along a linear track 17A, 17B, in directions of arrows 18 and 19, by any suitable means, such as, for example, electrical energization of an electric motor mounted on the carriage 16 via an electrified third track (not shown), or one of the tracks 17A and 17B (FIG. 5).

A motor 20 of any suitable known type, such as, for example, an electric motor, is mounted on the carriage 16 and coupled to the applicator bracket 14 by any suitable means, such as, for example, a rack and pinion, or gear arrangement 21 (FIG. 6) of any suitable known type. The motor 20 is thus readily electrically controlled to move the applicator bracket 14 in directions of arrows 22 and 23 at any position of the carriage 16, whereas said carriage is readily electrically controlled to position itself, and thus said applicator bracket, at any desired position on the mounting bracket 7.

Figure 6:
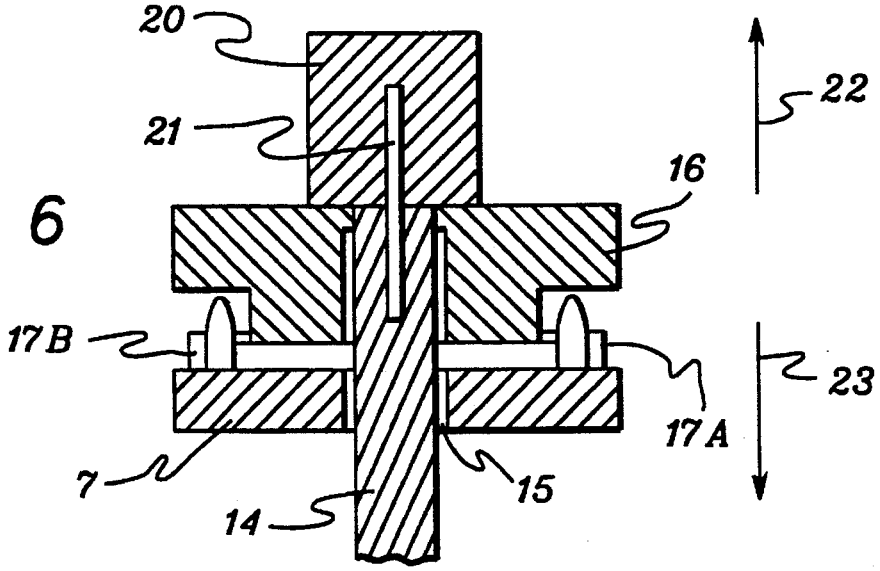
FIG. 6 is a cross-sectional view, taken along the lines VI–VI, of FIG. 5.

Thus, as shown in FIGS. 5 and 6, the applicator is adjustably positionable relative to the feed blade to the atomizing surface 3 of the spray head 2 in planes substantially parallel to and in planes substantially perpendicular to said atomizing surface.

The high frequency alternating voltage generator 5 utilizes MOSFET power transistors in a bridge type, transformer-coupled configuration (not shown in the FIGS.) to provide power to the converter 1. The DC supply voltage to the bridge circuit is varied to control the level of voltage delivered to one or more paralleled-connected converters (not shown in the FIGS.), as desired. The control and drive circuit for the bridge transistors utilizes a voltage-controlled oscillator configuration (not shown in the FIGS.) to generate the frequency required for the array of converters.

The spray coating system of the invention uses macrosonic, or high-intensity ultrasonic, vibrations to atomize fluid. The vibrations produce capillary waves on a film of fluid which is caused to flow on the macrosonically vibrating surface 3. A sufficiently large vibration amplitude causes small diameter drops to break from the crests of the capillary waves and to be thrown from the atomizing surface 3. The mean drop diameter d is related to the operating frequency and has been characterized, in "Ultrasonics" by D. Ensminger, Marcel Dekker, 1988, for a very low flow and drive amplitude as follows:

$$d \sim k\,\lambda c \text{ cm}$$

where λc is the wavelength of the capillary waves and is approximated by $$\lambda c \approx \left(\frac{8\pi T}{\sigma f^2}\right)^{1/3}$$

where T is the surface tension, σ is the density of the fluid, f is the drive frequency in Hz and k is an experimentally determined constant which is less than, or equal to, 0.5.

For a system atomizing water at 25° C. and operating at 50 kHz this calculation provides a mean drop size of under 50 μm and compares well with experience.

Figure 7:
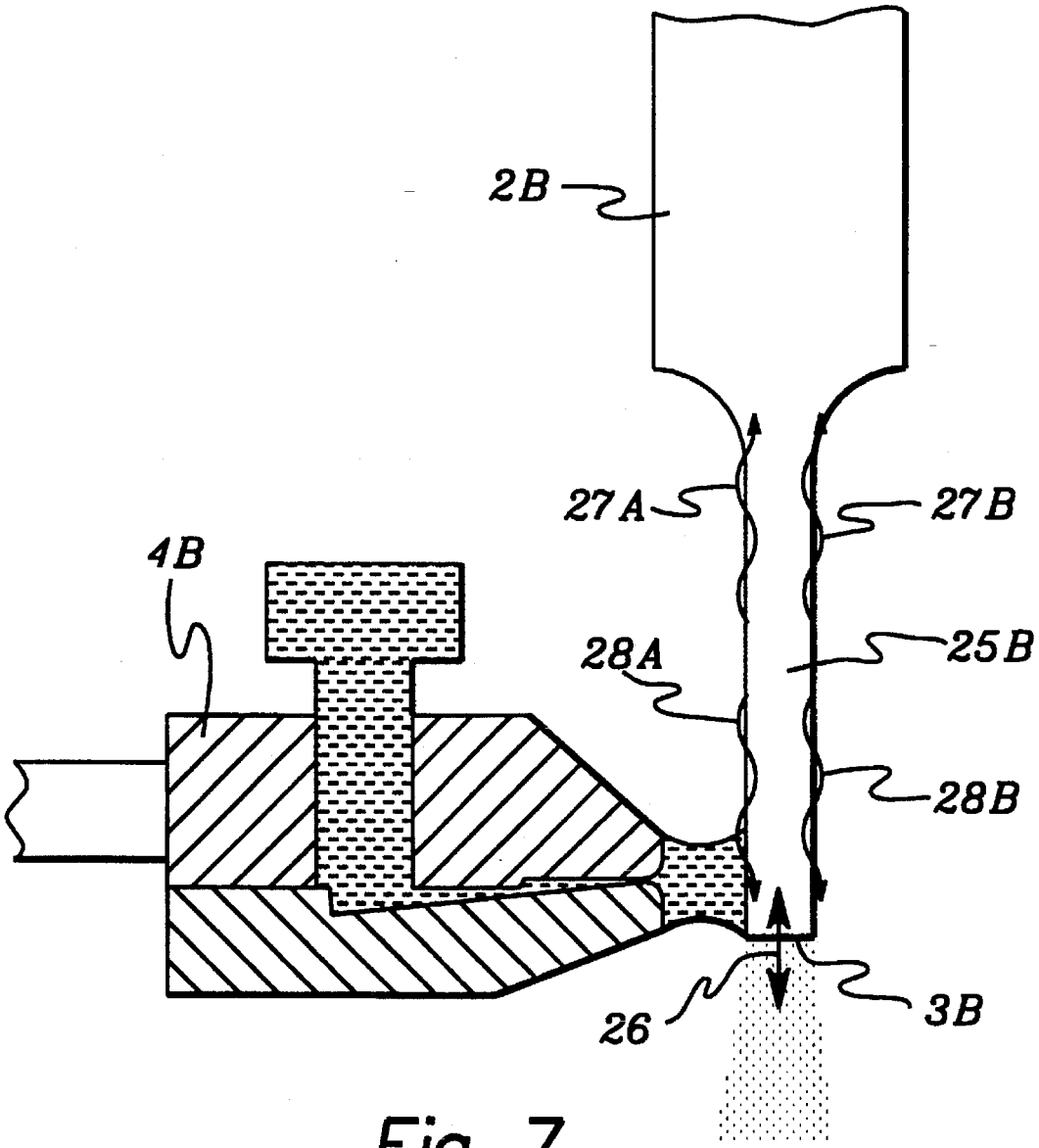
FIG. 7 is a schematic diagram, on an enlarged scale, and partly in section, of the principal components of the ultrasonic spray system of the invention.

FIG. 7 is an enlarged view of the spray head 2B of the fluid supply applicator 4B. The spray head 2B concentrates the vibrations at its atomizing or feed blade surface 25B. As shown in FIG. 7, an anti-node 26 is produced by maximum displacement of the spray head tip 3B due to standing wave. Surface waves 27A and 27B travel in a +Z direction away from the spray head tip 3B. This is detrimental to the production of a uniform spray pattern. Surface waves 28A and 28B travel in a –Z direction in the vicinity of the spray head tip 3B over the width of said spray head tip. This is critical to producing a uniform spray pattern.

Although shown and described in what is believed to be the most practical and preferred embodiment, it is apparent that departures from the specific ultrasonic spray coating system described and shown will suggest themselves to those skilled in the art and may be made without departing from the spirit and scope of the invention. We, therefore, do not wish to restrict ourselves to the particular construction described and illustrated, but desire to avail ourselves of all modifications that my fall within the scope of the appended claims.

We claim:

1. An Ultrasonic spray coating system, comprising:

a converter for converting high frequency electrical energy into high frequency mechanical energy thereby producing vibrations;

a spray head coupled to said converter, said spray head having a narrowed tip with substantially planar opposing side surfaces, the tip of the spray head terminating at a substantially planar atomizing surface, at least one of the side surfaces comprising a feed blade being substantially perpendicular to the atomizing surface;

a high frequency alternating voltage generator electrically connected to said converter for producing a controlled level and frequency of electrical energy wherein the atomizing surface is uniformly displaced in a normal direction by the vibrations and wherein a surface wave component is induced in a first region along the feed blade, the surface effect component being in a direction toward the atomizing surface; and a liquid supply applicator in close proximity with the first region of said feed blade and spaced therefrom, said liquid supply applicator having an output surface having an output orifice such that liquid supplied from the orifice to the feed blade flows under the influence of the surface wave component of said atomizing surface where said liquid is atomized by the displacement of said atomizing surface and is thereby changed to a spray.

2. An ultrasonic spray coating system as claimed in claim 1, wherein said spray head has a substantially rectangular spray head and said atomizing surface and said output surface of said applicator have substantially parallel lengths and said orifice is a continuous slot extending substantially parallel to and for the length of said output surface.

3. An ultrasonic spray coating system, comprising:

a converter for converting high frequency electrical energy into high frequency mechanical energy thereby producing vibrations, a spray head coupled to said converter, said spray head having a narrowed tip with substantially planar opposing side surfaces, the tip of the spray head terminating at a substantially planar atomizing surface, at least one of the side surfaces comprising a feed blade being substantially perpendicular to the atomizing surface;

a high frequency alternating voltage generator electrically connected to said converter means and producing a controlled level and frequency of electrical energy wherein the atomizing surface is uniformly displaced in a normal direction by the vibrations and wherein a surface wave component is induced in a first region along the feed blade, the surface effect component being in a direction toward the atomizing surface;

a liquid supply applicator in close proximity with the first region of said feed blade and spaced therefrom in a manner whereby liquid supplied by said applicator to said feed blade flows under the influence of the surface wave component to said atomizing surface where said liquid is atomized by the displacement of said atomizing surface and is thereby changed to a spray;

mounting means; and mounting bracket means affixing said converter, said spray head and said liquid supply applicator to said mounting means.

4. An ultrasonic spray coating system as claimed in claim 3, further comprising an applicator bracket adjustably affixed to said mounting bracket means and said liquid supply applicator being affixed to said applicator bracket whereby said applicator is adjustably positioned relative to said atomizing surface of said spray head.

5. An ultrasonic spray coating system as claimed in claim 3, wherein said liquid supply applicator has an output surface having an orifice therein and said output surface is in close proximity with said feed blade and spaced therefrom, said output surface of said applicator and said atomizing surface being at substantially right angles to each other.

6. An ultrasonic spray coating system as claimed in claim 5, wherein said atomizing surface and said output surface of said applicator have substantially parallel lengths and said orifice is a continuous slot extending substantially parallel to and for the length of said output surface.

7. An ultrasonic spray coating system as claimed in claim 6, wherein said spray head comprises a substantially rectangular spray head.

8. An ultrasonic spray coating system, comprising:

a converter for converting high frequency electrical energy into high frequency mechanical energy thereby producing vibrations;

a spray head coupled to said converter, said spray head having a narrowed tip with substantially planar opposing side surfaces, the tip of the spray head terminating at a substantially planar atomizing surface, at least one of the side surfaces comprising a feed blade being substantially perpendicular to the atomizing surface;

a high frequency alternating voltage generator electrically connected to said converter means and producing a controlled level and frequency of electrical energy wherein the atomizing surface is uniformly displaced in a normal direction by said vibrations and wherein a surface wave component is induced in a first region along the feed blade, the surface effect component being in a direction toward the atomizing surface;

a liquid supply applicator having an output surface with an orifice therein in close proximity with the first region of said feed blade and spaced therefrom in a manner whereby liquid supplied by said applicator to said feed blade flows under the influence of the surface wave component to said atomizing surface where said liquid is atomized by the displacement of said atomizing surface and is thereby changed to a spray;

mounting means;

mounting bracket means affixing said converter, said spray head and said liquid supply applicator to said mounting means; and an applicator bracket adjustably affixed to said mounting bracket means and said liquid supply applicator being affixed to said applicator bracket whereby said applicator is adjustably positionable relative to said feed blade of said spray head in planes substantially parallel to and in planes substantially perpendicular to said atomizing surface.

9. An ultrasonic spray coating system as claimed in claim 8, wherein said atomizing surface and said output surface of said applicator have substantially parallel lengths and said orifice is a continuous slot extending substantially parallel to and for the length of said output surface.

10. An ultrasonic spray coating system as claimed in claim 8, wherein said spray head has a substantially rectangular spray head.

11. An ultrasonic spray coating system comprising:

a spray head for accepting a controlled level and frequency of ultrasonic vibrations from a vibration source, the spray head having a narrowed tip, the narrowed tip terminating in an elongated planar atomizing surface and having two parallel opposing side surfaces, the two side surfaces being substantially perpendicular to the atomizing surface wherein the atomizing surface is uniformly displaced by the ultrasonic vibrations and a surface effect is induced along at least one of the two side surfaces; and a liquid supply applicator in close proximity with the at least one of the two side surfaces, the liquid supply applicator having an output surface with an elongated slot therethrough, the output surface being oriented substantially parallel to the at least one of the two side surfaces, such that liquid supplied from the slot to the at least one of the two side surfaces is caused to flow to the atomizing surface under the influence of the surface wave, the liquid being atomized and changed to a spray by the displacement of the atomizing surface.

12. An ultrasonic spray coating system comprising:

a spray head for accepting a controlled level and frequency of ultrasonic vibrations from a vibration source, the spray head having a narrowed tip, the narrowed tip terminating in an elongated planar atomizing surface and having two parallel opposing side surfaces, the two parallel opposing side surfaces being substantially perpendicular to the atomizing surface, at least one of the two parallel opposing side surfaces comprising a liquid feed blade, and wherein the atomizing surface is uniformly displaced by the ultrasonic vibrations; and a liquid supply applicator in close proximity with the liquid feed blade, the liquid supply applicator having an output surface with an elongated slot therethrough, the output surface being oriented substantially parallel to the liquid feed blade, such that liquid supplied from the slot to the liquid feed blade flows to the atomizing surface, the liquid being atomized and changed to a spray by the displacement of the atomizing surface.

* * * * *

UNITED STATES PATENT AND TRADEMARK OFFICE

CERTIFICATE OF CORRECTION

PATENT NO. : 5,540,384

DATED : Jul. 30, 1996

INVENTOR(S) : Erickson et al.

It is certified that error appears in the above-indentified patent and that said Letters Patent is hereby corrected as shown below:

Column 9, line 28, delete "of" and substitute therefor --to--.

Column 11, line 9, delete "effect" and substitute therefor --wave--.

Signed and Sealed this

Twenty-sixth Day of November 1996

*Attest:*

Bruce Lehman

BRUCE LEHMAN

*Attesting Officer*

*Commissioner of Patents and Trademarks*